United States Patent [19]

Bonebright et al.

[11] Patent Number: 4,531,129

[45] Date of Patent: Jul. 23, 1985

[54] MULTIPLE-FEED LUNEBERG LENS SCANNING ANTENNA SYSTEM

[75] Inventors: Mark E. Bonebright, La Mesa; Everett C. Mehner, San Diego, both of Calif.

[73] Assignee: Cubic Corporation, San Diego, Calif.

[21] Appl. No.: 471,047

[22] Filed: Mar. 1, 1983

[51] Int. Cl.[3] ..... H01Q 19/06

[52] U.S. Cl. ..... 343/754; 343/417; 343/911 L

[58] Field of Search ..... 343/754, 911 L, 753, 343/761, 417

[56] References Cited

U.S. PATENT DOCUMENTS

| | | | |
|---|---|---|---|
| 2,835,891 | 5/1958 | Peeler et al. | 343/754 |
| 2,875,439 | 2/1959 | Berkowitz | 343/754 |
| 3,016,534 | 1/1962 | D'Agostino et al. | 343/725 |
| 3,230,535 | 1/1966 | Ferrante et al. | 343/754 |
| 3,487,413 | 12/1969 | Shores | 343/754 |
| 3,543,271 | 11/1970 | Scheel | 343/911 L |
| 3,680,123 | 7/1972 | Bryant et al. | 343/113 R |
| 3,757,333 | 9/1973 | Procopio | 343/100 R |
| 3,765,024 | 10/1973 | Chiron et al. | 343/854 |
| 3,827,055 | 7/1974 | Bogner et al. | 343/754 |
| 3,833,909 | 9/1974 | Schaufelberger | 343/754 |
| 3,835,469 | 9/1974 | Chen et al. | 343/754 |
| 3,848,255 | 11/1974 | Migdal | 343/761 |
| 4,255,751 | 3/1981 | Goodman, Jr. | 343/754 |
| 4,268,831 | 5/1981 | Valentino et al. | 343/754 |
| 4,287,519 | 9/1981 | Doi | 343/725 |
| 4,316,195 | 2/1982 | Steffek et al. | 343/758 |
| 4,359,741 | 11/1982 | Cassel | 343/754 |

*Primary Examiner*—Eli Lieberman

*Attorney, Agent, or Firm*—Brown, Martin & Haller

[57] ABSTRACT

A multiple-feed Luneberg lens scanning antenna system. A Luneberg lens disposed for rotation. A first antenna feed is connected to and defines a first feed point on the surface of the lens. A plurality of second antenna feeds are respectively connected to and define a plurality of second feed points outside and closely adjacent the periphery of the lens. Supporting structure separately supports each of the second feeds at positions independent of the rotation of the lens. A drive system is coupled to the supporting structure for separately positioning each of the second feeds. The drive system also is coupled to the lens for rotating the lens to cause the first feed point to scan over a wide angle. A control system is coupled to the first feed for receiving and processing signals received in response to the first feed point scanning over the wide angle and is coupled to the drive system for causing the drive system to separately position each of the second feeds in response to the processed signals to continuously track a respective plurality of targets of interest.

8 Claims, 3 Drawing Figures

FIG. 1
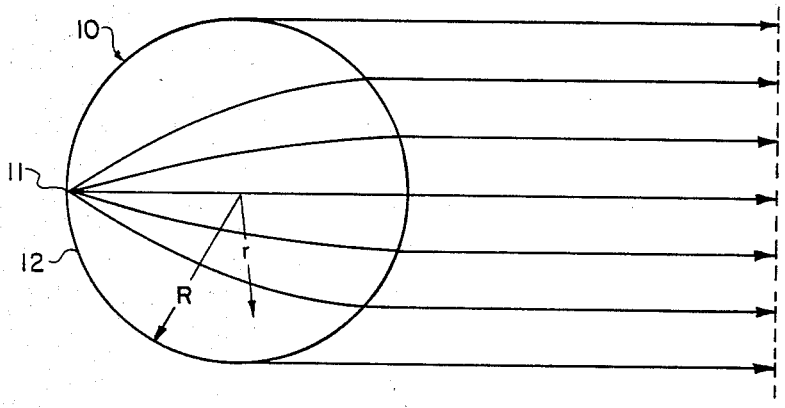
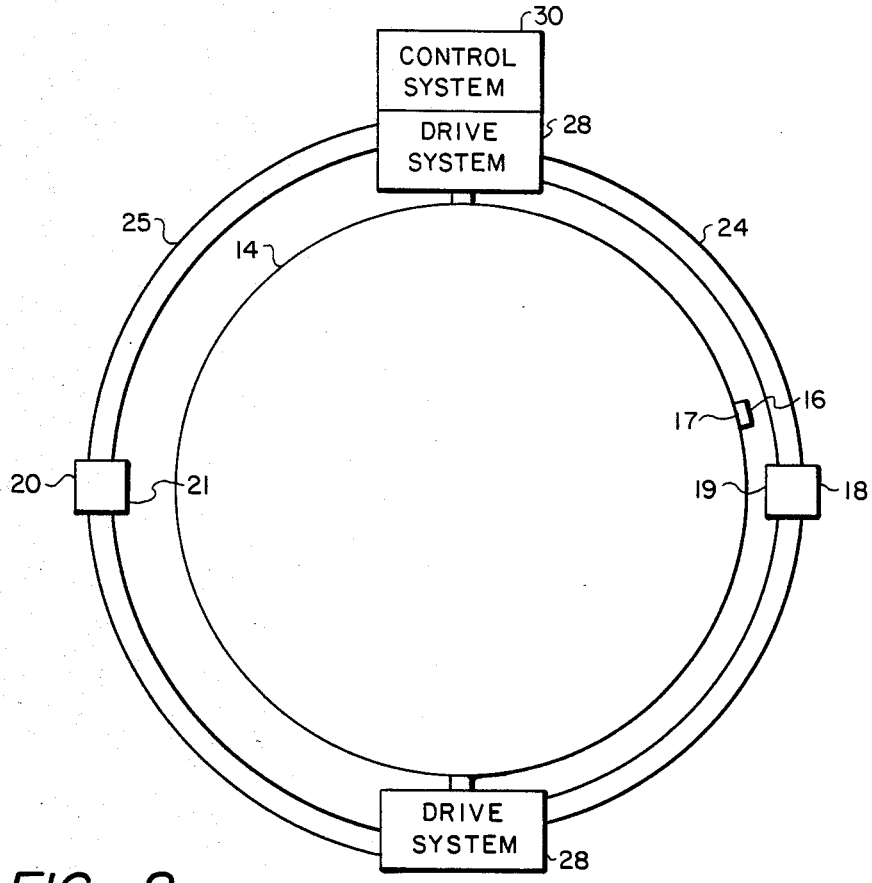
FIG. 2

MULTIPLE-FEED LUNEBERG LENS SCANNING ANTENNA SYSTEM

BACKGROUND OF THE INVENTION

The present invention generally pertains to antenna systems and is particularly directed to an improvement in scanning antenna systems.

Scanning antenna systems, such as radar systems, are used for locating targets of interest over a wide angle. However, once targets of interest in one section of a scan are located and identified, tracking of such targets is disrupted when the antenna scans other sectors.

SUMMARY OF THE INVENTION

The present invention is a multiple-feed Luneberg lens scanning antenna system that enables continuous tracking of targets of interest.

The Luneberg lens may be either spherical or cylindrical. They have a variable refractive index and are capable of wide angle scanning.

Referring to FIG. 1, the design of a spherical Luneberg lens 10 is such that, if a point source 11 is located on the surface 12, the lens transforms the resulting spherical waves into a plane wave with the propagating vector aligned along the diameter passing through the feed point. The refractive index of the Luneberg lens is $$n(r)=n_R[2-(r\div R)^2]^{\frac{1}{2}} \qquad \text{(Eq. 1)}$$

where $r_R$ is the refractive index at r=R. In order to avoid reflections at the surface of the lens, is is usual to choose $n_R=1$. Equation 1 is also valid for a cylindrical Luneberg lens with a circular cross section. The index of refraction is maximum at the center where it equals the square root of two, and decreases to a value of unity on the periphery.

The antenna system of the present invention includes a Luneberg lens disposed for rotation; a first antenna feed connected to and defining a first feed point on the surface of the lens; a plurality of second antenna feeds respectively connected to and defining a plurality of second feed points outside and closely adjacent the periphery of the lens; supporting structure for separately supporting each of the second feeds at positions independent of the rotation of the lens; a drive system coupled to the supporting structure for separately positioning each of the second feeds and coupled to the lens for rotating the lens to cause the first feed point to scan over a wide angle; and a control system coupled to the first feed for receiving and processing signals received in response to the first feed point scanning over the wide angle and coupled to the drive system for causing the drive system to separately position each of the second feeds in response to the processed signals to continuously track a respective plurality of targets of interest.

The system may include either a spherical Luneberg lens or a cylindrical Luneberg lens.

The rotation system may be adapted to rotate the lens over 360 degrees.

BRIEF DESCRIPTION OF THE DRAWING

FIG. 1 illustrates the refraction characteristic of a spherical Luneberg lens.

FIG. 2 is a view of an antenna system according to the present invention including a spherical Luneberg lens.

FIG. 3 is applicable to a system including either a spherical Luneberg lens or a cylindrical Luneberg lens.

DESCRIPTION OF THE PREFERRED EMBODIMENT

Figure 3:
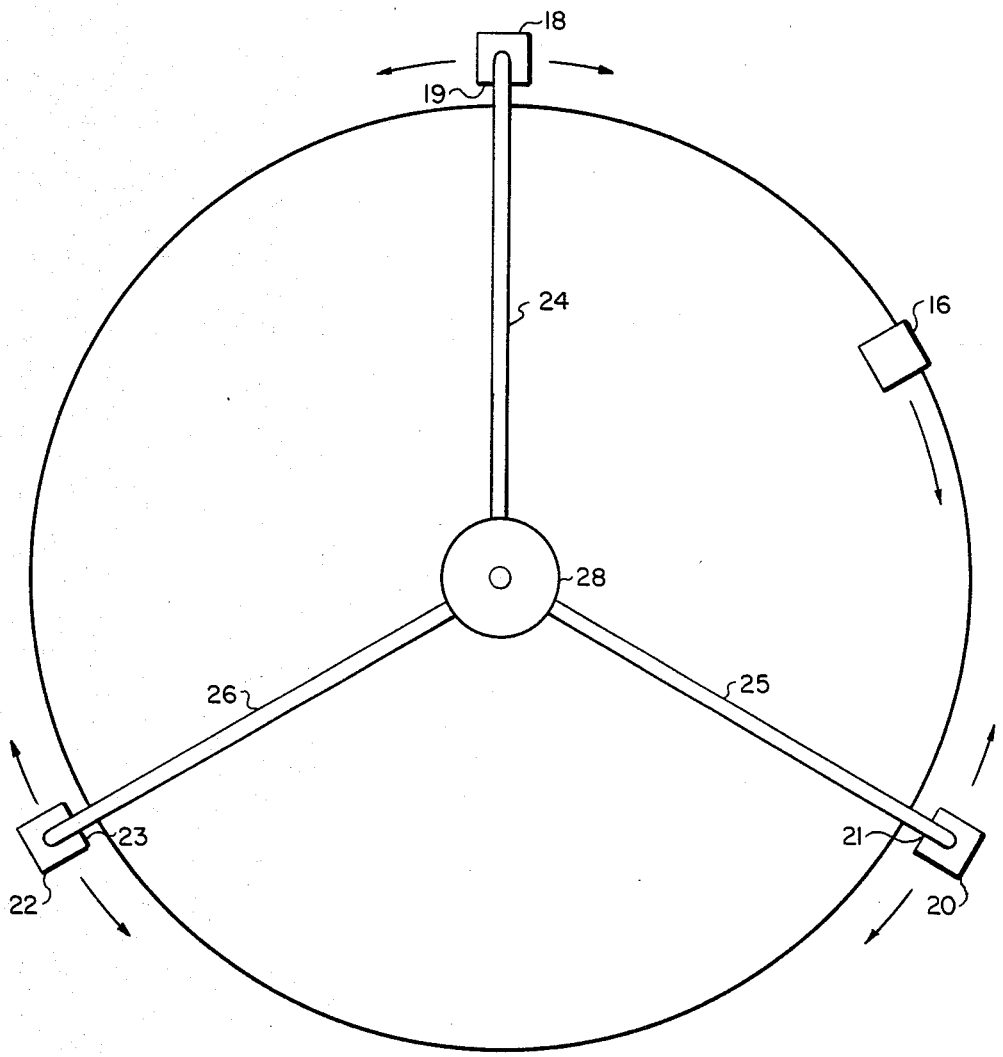
FIG. 3 is a top view in relation to FIG. 2 illustrating the positioning of the supporting structure and the feed points in the antenna system of the present invention.

Referring to FIGS. 2 and 3, a preferred embodiment of the scanning antenna system of the present invention includes a spherical Luneberg lens 14 disposed for rotation.

A first antenna feed 16 is connected to and defines a first feed point 17 on the surface of the lens 14. Additional antenna feeds 18, 20, 22 are respectively connected to and define a plurality of additional feed points 19, 21, 23 outside and closely adjacent the periphery of the lens 14.

Supporting structures 24, 25, 26 separately support each of the additional feeds 18, 20, 22 at positions that are independent of the rotation of the lens 14.

A drive system 28 is coupled to the supporting structures 24, 25, 26 for separately positioning each of the additional feeds 18, 20 22. The drive system 28 also is coupled to the lens 14 for rotating the lens 14 to cause the first feed point 17 to scan over a wide angle, preferably 360 degrees. The drive system 28 includes separate combinations of drive motors, synchro systems and rotary joints coupled to the lens 14 and to the respective supporting structures 24, 25, 26 for the additional antenna feeds 18, 20, 22.

A control system 30 is coupled to the first feed 16 by a coaxial cable (not shown) for receiving and processing signals received in response to the first feed point 17 scanning over the wide angle and is coupled to the drive system 28 for causing the drive system 28 to separately position each of the additional feeds 18, 20, 22 in response to the processed signals to continuously track a respective plurality of targets of interest.

We claim:

1. A multiple-feed Luneberg lens scanning antenna system comprising a Luneberg lens disposed for rotation; first antenna feed means connected to and defining a first feed point on the surface of the lens;

a plurality of second antenna feed means respectively connected to and defining a plurality of second feed points outside and closely adjacent the periphery of the lens;

support means for separately supporting each of the second feed means at positions independent of each other and of the rotation of the lens;

drive means coupled to the support means for separately positioning each of the second feed means and coupled to the lens for rotating the lens to cause the first feed point to scan over a wide angle; and control means coupled to the first feed means for receiving and processing singals received in response to the first feed point scanning over said wide angle and coupled to the drive means for causing the drive means to separately position each of said second feeds in response to said processed signals to continuously track a respective plurality of targets of interest.

2. An antenna system according to claim 1, wherein the lens is spherical.

3. An antenna system according to claim 1, wherein the lens is cylindrical.

4. An antenna system according to claim 1, wherein the rotation means is adapted to rotate the lens over 360 degrees.

5. A multiple-feed luneberg lens scanning antenna system comprising:

a Luneberg lens disposed for rotation;

first antenna feed means connected to and defining a first feed point on the surface of the lens;

secondary antenna feed means connected to and defining a second feed point outside and closely adjacent the periphery of the lens;

support means for supporting the secondary feed means at a position independent of the rotation of the lens;

drive means coupled to the support means for positioning the secondary feed means and coupled to the lens for rotating the lens to cause the first feed point to scan over a wide angle; and control means coupled to the first feed means for receiving and processing signals received in response to the first feed point scanning over said wide angle and coupled to the drive means for causing the drive means to position said secondary feed in response to said processed signals to continuously track a respective target of interest.

6. An antenna system according to claim 5 wherein the lens is spherical.

7. An antenna system according to claim 5 wherein the lens is cylindrical.

8. An antenna system according to claim 5 wherein the rotation means is adapted to rotate the lens over 360 degrees.

* * * * *